US006552345B2

(12) United States Patent
Asano et al.

(10) Patent No.: US 6,552,345 B2
(45) Date of Patent: Apr. 22, 2003

(54) THERMOPILE FAR INFRARED RADIATION DETECTION APPARATUS FOR CRIME PREVENTION

(75) Inventors: Takeshi Asano, Chiba (JP); Hiroyuki Yajima, Chiba (JP)

(73) Assignee: Matsuda Micronics Corporation, Kashiwa (JP)

( * ) Notice: Subject to any disclaimer, the term of this patent is extended or adjusted under 35 U.S.C. 154(b) by 0 days.

(21) Appl. No.: 09/849,266

(22) Filed: May 7, 2001

(65) Prior Publication Data

US 2001/0045520 A1 Nov. 29, 2001

(30) Foreign Application Priority Data

May 9, 2000 (JP) ..... 2000-136072

(51) Int. Cl.[7] ..... G08B 13/18
(52) U.S. Cl. ..... 250/342; 250/338.1; 250/340
(58) Field of Search ..... 250/342, 338.1, 250/340, 353; 340/567; 136/224, 225, 227

(56) References Cited

U.S. PATENT DOCUMENTS 4,318,089 A * 3/1982 Frankel et al. ..... 340/567
4,943,800 A * 7/1990 Ikeda et al. ..... 340/567

FOREIGN PATENT DOCUMENTS

| | | |
|---|---|---|
| DE | 195 48 578 | 7/1997 |
| EP | 0 624 857 | 11/1994 |
| JP | 4-225190 | 8/1992 |
| JP | 4-225191 | 8/1992 |
| JP | 6-323905 | 11/1994 |
| JP | 8-146150 | 6/1996 |
| JP | 9-113355 | 5/1997 |
| JP | 10-5180 | 1/1998 |
| JP | 11-14451 | 1/1999 |
| JP | 2000-146689 | 5/2000 |
| JP | 2000-275100 | 10/2000 |

* cited by examiner

*Primary Examiner*—Constantine Hannaher
*Assistant Examiner*—Timothy Moran
(74) *Attorney, Agent, or Firm*—Armstrong, Westerman & Hattori, LLP

(57) ABSTRACT

A thermopile far infrared radiation detection apparatus for crime prevention that is capable of detecting with certainty an intruder who is entering a monitoring space regardless of temperature changes of the space or how fast the intruder enters the space. The detection apparatus utilizes three or more thermopiles to detect an intruder into the space and in which output difference between detection values outputted from a pair of said thermopiles is obtained, and then, the intruder is detected by the comparison between these output differences obtained from different pairs of the thermopiles.

6 Claims, 10 Drawing Sheets

PRIOR ART

PRIOR ART when an intruder enters the detection spaces

PRIOR ART

PRIOR ART

PRIOR ART

THERMOPILE FAR INFRARED RADIATION DETECTION APPARATUS FOR CRIME PREVENTION

BACKGROUND OF THE INVENTION (1) Field of the Invention

The present invention relates to a thermopile far infrared radiation detection apparatus for crime prevention and an indoor type thermopile far infrared radiation detection apparatus for crime prevention, which detect an intruder into a space by using three or more thermopiles.

(2) Description of the Prior Art

Conventionally, as a method to detect an intruder into a space such as an office, such method is known that it detects a temperature emitted from a human body, that is, a far infrared radiation; and as a detector thereof, passive infrared detection devices such as pyroelectric devices, thermopiles, etc. are used.

A pyroelectric device, which is conventionally used, is a device that detects a change in temperature; and is effective in the case where an intruder enters at a speed more than a predetermined speed.

At first, a conventional detection method utilizing a single pyroelectric device will be explained in reference to FIGS. 9–12.

FIG. 9 shows a detection apparatus c in which a lens b is provided in front of a detector a which has a pyroelectric device. d in the figure shows a human body which moves in the space.

A far infrared radiation which is emitted from the human body d is converged onto the detector a by the lens b. The detector a outputs an electric signal if the amount of the far infrared radiation changes; and by this output, it is detected as to whether or not there is an intruder in the space.

FIGS. 10 and 11 show output changes from the detector a in the case where a human body d is moving in the space. When the human body d enters the detection space, the detector a detects a temperature of the human body d and outputs such detection as an electric signal. In accordance with the movement of the human body, the output value changes up and down as time goes. Next, when the human body d is inside the detection space, no output changes appear since the amount of far infrared radiation which enters into the detector a is uniform. And, when the human body d exits from the detection space, the detector a detects the temperature of the human body d and outputs the detection as an electrical signal. In accordance with the movement of the human body d, the output value changes up and down as time goes.

Here, FIG. 10 shows the case in which the human body d moves at a high speed; and, FIG. 11 shows the case in which the human body d moves at a low speed.

As apparent from these FIGS. 10 and 11, in case that a human body d is moving at a certain speed, it is easy to detect changes of the human body d; however, in case that a human body is moving slowly or stands still, the detector is not able to clearly detect the differences between the body temperature and the room temperature.

As explained above, in case that a pyroelectric device is used for detection, when an intruder's speed in entering is slow or an intruder stands still, the change between the intruder's temperature and background temperature inside the space, namely, the difference between body temperature of the intruder and the room temperature is not be able to be distinguished; thereby, it is not possible to surely detect an intruder.

On the other hand, a thermopile detects an absolute value of the temperature rather than the changes in temperature as in the case of pyroelectric device; therefore, it is conventionally used as a radiation thermometer to measure an absolute value of the temperature of the subject of measurement.

FIG. 12 shows the output changes generated in response to the movement of a human body d when a conventional thermopile is used in the configuration shown in FIG. 9. FIG. 12 shows respective output changes in the cases: the room temperature is 25° C.; the room temperature is higher than 25° C.; and the room temperature is lower than 25° C.

FIG. 13 shows an output change in the case where the output signal is treated such that the detection of far infrared radiation by a thermopile is as same as the detection responses of a pyroelectric device.

Further, there is such a detection method of an intruder into a space that utilizes a thermal image device in which a plurality of thermopiles are arranged in two dimensions; an output of each devices is retrieved; and outputs from all devices are treated as a thermal image.

A conventional configuration which utilizes a plurality of thermopile devices is explained in reference to FIGS. 14–17.

FIG. 14 shows a detection apparatus g in which a lens f is disposed of in front of detectors e1, e2 and e3, which are provided with variable amplifiers j1, j2 and j3. In this figure, h1, h2 and h3 indicate respective spaces in which the detectors e1, e2 and e3 are capable of detection. If a human body moves in either of spaces h1, h2 and h3, the temperature of the human body is detected through the lens f by one of the detectors e1, e2 or e3; the detected far infrared radiation, that is, the body temperature, is amplified by the variable amplifiers j1, j2 and j3 as electric outputs; and is outputted as electric signal outputs k1, k2 and k3. And, by the changes of these outputs k1, k2 and k3, it is detected whether or not there has been an entry of intruder.

Accordingly, the thermal distributions of spaces h1, h2 and h3 are always measured; and in case no intruder is in either of h1 and h2 or h3, there is almost no differences among the outputs k1, k2 and k3 as shown in FIG. 15A; however, if an intruder enters into either of h1, h2 and h3, due to the temperature of a human body, the temperature of one of the spaces h1, h2 or h3 increases and in accordance with it, there will be a difference among the outputs k1, k2 and k3 from these variable amplifiers j1, j2 and j3 as shown in FIG. 15B. FIG. 15B shows that an intruder has entered the space h2. By increasing the number of the detectors, e1, e2 and e3, it becomes possible to measure detailed thermal distributions in the prescribed area, thereby, it becomes possible to capture a whole detection space as an image (infrared image) and it becomes possible to make sure that there has been an entry be intruder into the space.

Incidentally, FIG. 16 shows the output changes of thermopile in response to the changes of room temperature.

As shown in the figure, in the cases in which the room temperature is either low or high, a proper output cannot be generated because the output is saturated. Therefore, when the room temperature is low, it is necessary to increase the sensitivity; and when the room temperature is high, it is necessary to decrease the sensitivity. Therefore, as shown in FIG. 14, the input side and the output side of the variable amplifiers j1, j2 and j3 are connected to an automatic sensitivity adjustment apparatus m; and the outputs k1, k2 and k3 from the variable amplifiers j1, j2 and j3 are adjusted to maintain an average value by the variable amplifiers j1, j2 and j3.

FIG. 17 shows another conventional detection apparatus. The detection apparatus shown in the figure is configured such that a plurality of detector e1, e2, e3, e4 and e5 are connected to an amplifier n, which amplifies outputs obtained from the respective detectors through an electronic switch p. And, by sequentially switching the electronic switch p, outputs from the respective detectors e1, e2, e3, e4 and e5 are detected and are output after amplification by the amplifier n.

However, even in the case where a thermopile is used, if a single thermopile is used and the room temperature is high, the difference z1 between the room temperature and the body temperature is very slight as shown in FIG. 12, therefore, the output changes cannot be detected sufficiently and it is not possible to assuredly determine to make an output that there is a human body. Further, in the case where the room temperature is low, the difference between the room temperature and the body temperature Z2 is large so that it is possible to make an output assuredly making a determination of the body temperature; however, it also detects the room temperature changes. Therefore, if the detection sensitivity is decreased in order not to detect such room temperature changes, the problem that it cannot detect the temperature changes caused by the entry of a human body arises.

Accordingly, such a method as shown in FIG. 13 may be conceivable that the intrusion by a human body is detected by outputting an electric signal that is converted from the temperature changes occurred when a human body enters into and exits from a detection space.

However, this method has a similar problem to that of the detection method which uses pyroelectric devices, that is, it cannot make a detection in case that a human body moves slowly or stands still in the detection space.

Further, even in the case of the configurations as shown in FIGS. 14 and 17 in which a plurality of thermopiles are used, since the change of the room temperature is larger than that caused by the human body temperature, it is not possible to detect the intrusion.

Further, in a case of such a detection method, by which an intruder is detected, that utilizes a thermal image device in which a plurality of thermopiles are arranged in two dimensions, an output of each device is retrieved, and outputs from all devices are treated as a thermal image, it is necessary to make preliminary automatic sensitivity adjustments in order for the output from each device to remain within the detectable range. In other words, the space temperature changes in accordance with seasons, day or night, as well as opening and shutting of doors and windows; therefore, in accordance with such changes of the room temperature, preliminary automatic sensitivity adjustments are necessary; thereby, it makes sensitivity adjustments troublesome.

Furthermore, even in the case where the automatic sensitivity adjustments are done, if the room temperature distribution goes beyond both of the maximum value and minimum value, then, a detection cannot be made.

As explained thus far, the conventional detection apparatus cannot detect whether or not there is an intruder into the detection space unless an amplifier is provided with an automatic sensitivity adjustment function capable of automatic sensitivity adjustment of each detector in accordance with the room temperature changes since the outputs of each detector change in response to the increase and decrease of the room temperature.

Incidentally, in this type of detection apparatus, it is important to have an ability to detect an obstruction by which the detection is made impossible by placing a shielding board in front of the detector.

Furthermore, when there is no need to be concerned with a privacy issue such as in the case of outdoor, no privacy problem will be arisen by the use of the conventional detection apparatus that captures thermal images; however, if detection apparatuses are installed indoor such as in a company office, warehouse etc, in particular in a residence, use of the conventional detection apparatus which can monitor residents and guests by capturing as thermal images may create a problem of individual privacy violations.

Thereupon, removing the foregoing problems, it is an object of the present invention to provide a thermopile far infrared radiation detection apparatus for crime prevention that is capable of reliably detecting an intrusion of an intruder into a space regardless of the temperature change of the space or moving speed of the intruder.

Further, it is another object of the present invention to provide a thermopile far infrared radiation detection apparatus for crime prevention that can detect an obstruction by which the detection will be rendered impossible.

Further, it is yet another object of the present invention to provide a thermopile far infrared radiation detection apparatus for crime prevention that will not cause a problem of individual privacy violation.

SUMMARY OF THE INVENTION

To achieve the above objects and other objects, according to the present invention, as the first mode of the invention, there is provided a thermopile far infrared radiation detection apparatus for crime prevention utilizing three or more thermopiles to detect an intruder into a space, wherein, an output difference between detection values outputted from a pair of said thermopiles is obtained; and said intruder is detected by the comparison between said output differences obtained from different pairs of said thermopiles. By this mode of the invention, the background temperature changes, i.e., temperature changes in a space in accordance with the outside temperature changes that depend on whether it is in the morning, around noon or in the evening etc, or seasonal temperature changes that depend on whether it is spring, summer, autumn or winter, will not be outputted as an output difference since those temperature changes are canceled out by obtaining the output differences between detection values outputted from a pair of these thermopiles. Namely, even the background temperature changes, the output difference between detection values that are outputted from a pair of thermopiles is basically close to zero. Therefore, any automatic sensitivity adjustment is not necessary to make adjustment in accordance with the changes in the background temperature. On the other hand, an existence of an intruder can be detected with certainty since when the intruder enter a detection area of either one of the pair thermopiles, the radiation amount of the far infrared radiation emitted from the intruder changes, and therefore, an output difference from that pair involving the relevant thermopile will be different from other output differences. Here, since the output difference between detection values outputted from a pair of thermopiles is basically close to zero, even if that output difference is amplified significantly by an amplifier, that output value will not become abnormally large. Therefore, by amplifying the output difference, the detection sensitivity can be further improved.

Further, according to the present invention, there is provided, as the second mode, a thermopile far infrared radiation detection apparatus for crime prevention in accordance with the first mode, wherein, said output differences are obtained without amplifying said detection values from said thermopiles. By this mode of the invention, the output difference can be obtained accurately without any influences that may be caused by noises or a margin of error of the amplifier.

Further, according to the present invention, there is provided, as the third mode, a thermopile far infrared radiation detection apparatus for crime prevention in accordance with the first mode, wherein, nine or less of thermopiles are arranged in array. By this mode of invention, an accurate detection of an intruder can be done without using many numbers of thermopiles to capture a thermal image; furthermore, it can be demonstrated that an individual privacy is protected.

Further, according to the present invention, there is provided, as the fourth mode, a thermopile far infrared radiation detection apparatus for crime prevention in accordance with the first mode, wherein, in the case that signal difference between said output differences is below a first predetermined value, it will be judged that there is no intruder, and in the case said signal difference is below a second predetermined value, which is set at the value which is below said first predetermined value but is greater than zero, then it will be judged that a detection obstruction is perpetrated. By this mode of the invention, the obstructions of the detection performed by placing a shield plate in front of the detection apparatus can be detected. The output difference between detection values outputted from a pair of thermopiles is normally close to zero; however, since there are usually small variations in the background temperature, all of the output differences are not completely zero or infinitely close to zero. However, in case such detection obstructions is perpetrated by placing a shield plate in front of the detection apparatus, since the shield plate causes approximately uniform output differences, by detecting this condition, it is possible to detect that a detection obstruction using a shield plate is being committed.

Further, according to the present invention, there is provided, as the fifth mode, a thermopile far infrared radiation detection apparatus for crime prevention in accordance with any of the modes 1 through 4, wherein, said thermopile far infrared radiation detection apparatus for crime prevention is installed indoor. The detection apparatus of any of the mode 1 through 4 uses the output differences of detection values outputted from a pair of thermopiles; therefore, it is not possible to reproduce an image. Therefore, even many number of thermopile devices are utilized, it is not possible to reproduce a thermal image such as that taken by an infrared camera; therefore, no privacy problem may be caused and it is suitable to install indoor, in such places as a company office, warehouse etc. in particular in an ordinary residence.

Further, according to the present invention, there is provided, as the sixth mode, a thermopile far infrared radiation detection apparatus for crime prevention in which thermopiles are arranged in array consisting a plurality of rows and a plurality of columns to detect an intruder into a space, which is characterized in that: an output difference between detection values outputted from a pair of said thermopiles which are aligned in said column direction and an output difference between detection values outputted from a pair of said thermopiles which are aligned in said row direction are obtained; and said intruder is detected by the comparison between said output differences. By this mode of the invention, the output differences between the monitoring locations in the vertical directions differ in such a way that in the case of a small animal it will be large, and in the case of an intruder it will be small; therefore, by detecting such differences, it is possible to avoid a detection error which is caused by a small animal.

DETAILED DESCRIPTION OF THE PREFERRED EMBODIMENTS

One of the embodiments of the present of invention of a thermopile far infrared radiation detection apparatus for crime prevention will be explained with reference to the drawings below.

Figure 1:
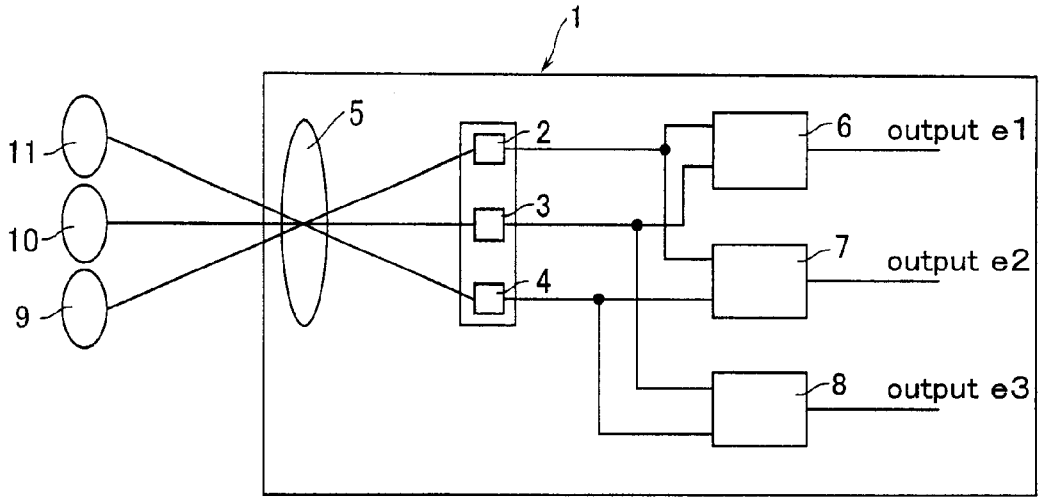
FIG. 1 is a basic structural diagram of a thermopile far infrared radiation detection apparatus for crime prevention of an embodiment of the present invention.
Figure 2:
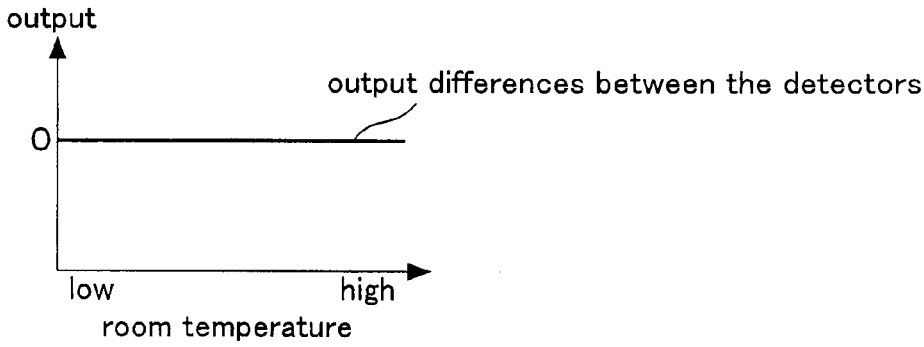
FIG. 2 is a chart showing the output between respective thermopiles of the above embodiment.
Figure 3A:
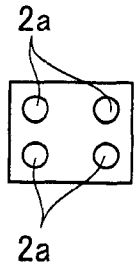
FIG. 3 is a structural diagram showing the arrangements of thermopiles of the above embodiment.
Figure 3B:
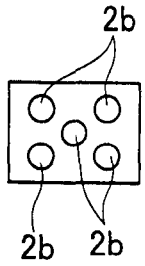
Figure 3C:
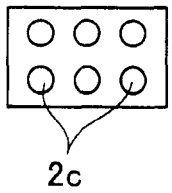
Figure 3D:
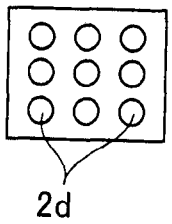
Figure 3E:
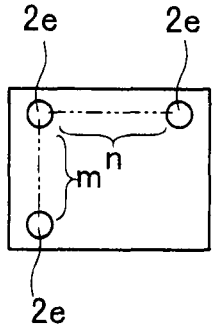

With reference to FIGS. 1 and 2, the basic principle of the present invention of the detection apparatus will be explained.

As shown in FIG. 1, the detection apparatus 1 is comprised of: a convex lens 5 provided in front of the detectors 2, 3 and 4, having thermopiles that can detect far infrared radiations; and the amplifiers 6, 7 and 8, which are provided to amplify the detection values of the detectors 2, 3 and 4.

The detector 2 is connected to the amplifier 6 and the amplifier 7; the detector 3 is connected to the amplifier 6 and the amplifier 8; and the detector 4 is connected to the amplifier 7 and the amplifier 8. Thereby, the amplifier 6 amplifies the difference between these outputs from the detector 2 and the detector 3; the amplifier 7 amplifies the difference between these outputs from the detector 2 and the detector 4; and the amplifier 8 amplifies the difference between these outputs from the detector 3 and the detector 4.

The detection apparatus 1 is provided in a space, for example, in the vicinity of the ceiling of an office, detects an intrusion of intruder by dividing such space into the detection spaces 9, 10 and 11 through the lens 5.

Here, these outputs of these detectors 2, 3 and 4 are not compared individually; but rather, with respect to an output from one detector, the difference between such output and an output from either of remaining detectors is amplified; more particularly, the amplifier 6 amplifies the output difference between the detector 2 and the detector 3, the amplifier 7 amplifies the output difference between the detector 2 and the detector 4, and the amplifier 8 amplifies the output difference between the detector 3 and the detector 4.

By this way, an amplifier amplifies the output difference of the detection values from two detectors; therefore, no influence will be caused at all by the temperature of the detection space, i.e., the room temperature.

More specifically speaking, when the room temperature goes up, thereby, the output of the detector 2 increases; however, the output of the other detector 3 increases likewise so that no output difference occurs between the outputs of the detectors as shown in FIG. 2; therefore, the output of the amplifier does not change. Accordingly, in accordance with the present embodiment, no automatic sensitivity adjustment among the detectors is necessary.

Next, the detection part of the detection apparatus 1 will be explained with reference to FIGS. 3 through 6.

FIG. 3 shows arrangements of thermopiles. In order to capture the detection space planarly, a plurality of thermopiles are arranged in arrays along the x axis direction as well as the y axis direction of the plane. FIG. 3(A) shows an arrangement in which four thermopiles 2*a* are arranged in arrays; FIG. 3(B) shows an arrangement in which five thermopiles 2*b* are arranged in arrays; FIG. 3(*c*) shows an arrangement in which six thermopiles 2*c* are arranged in arrays; FIG. 3(D) shows an arrangement in which nine thermopiles 2*d* are arranged in arrays; FIG. 3(E) shows an arrangement in which thermopiles 2*e* are arranged in arrays n×m. Incidentally, it is sufficient if there are at least three thermopiles; apparently, there are more thermopiles, the effect of more specifically identifying the specific space where an intrusion has occurred increases; but, less than nine thermopiles can provide satisfactory effects.

Figure 4:
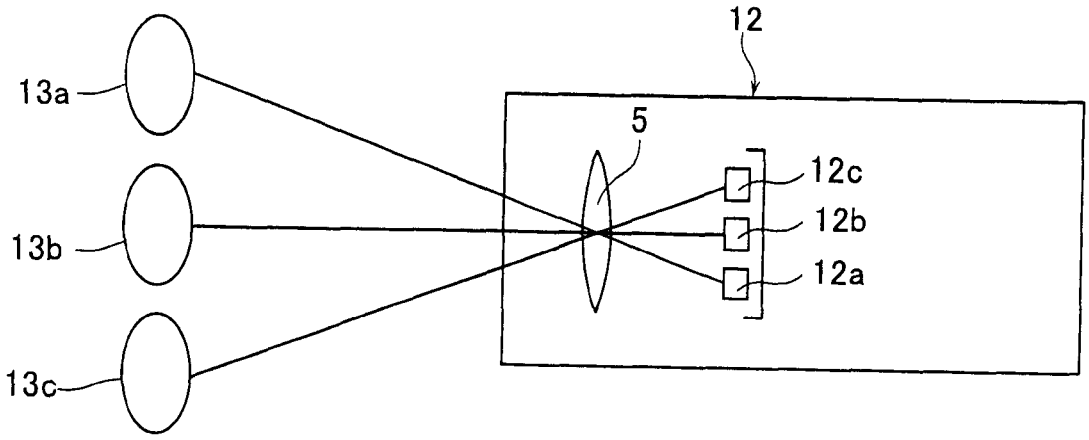
FIG. 4 is a structural diagram of the detection part using three thermopiles in accordance with an embodiment of the present invention.

FIG. 4 is a block diagram showing the configuration of the detection part 12 where three thermopiles 12*a*, 12*b* and 12*c* are used; the detection part 12 is configured such that the lens 5 is provided in front of the thermopiles 12*a*, 12*b* and 12*c* which are arranged in arrays. These thermopiles 12*a*, 12*b* and 12*c* detect through the lens 5 an intrusion of intruder into the detection spaces 13*a*, 13*b* and 13*c*.

Figure 5:
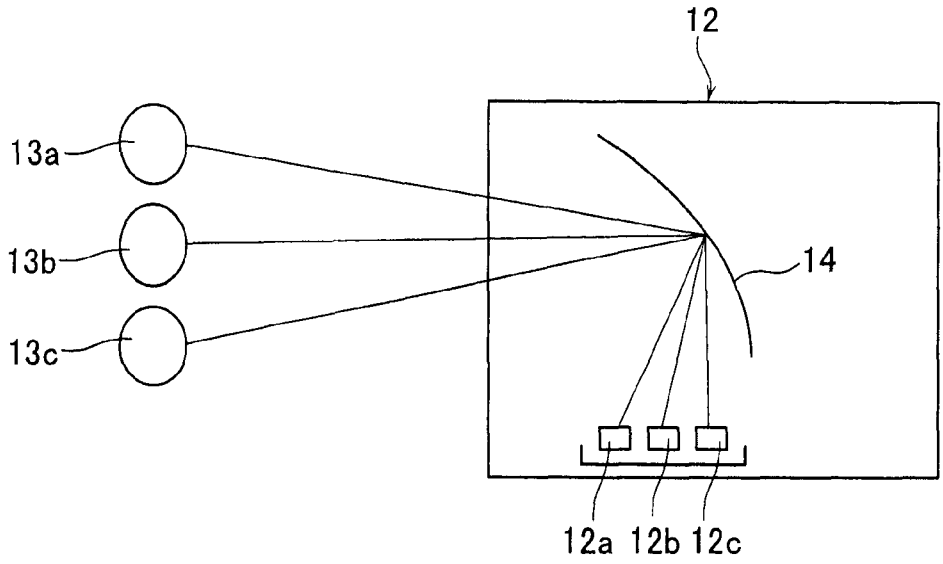
FIG. 5 is a structural diagram of the detection part of another embodiment of the present invention.

FIG. 5 shows an embodiment in which in place of the lens 5 shown in FIG. 4, a concave mirror 14 is used. It is configured in such a way that when an intruder enters the detection spaces 13*a*, 13*b* or 13*c*, the body temperature of the intruder will be reflected on the concave mirror 14 and will be detected by either of thermopiles 12*a*, 12*b* or 12*c*.

Figure 6:
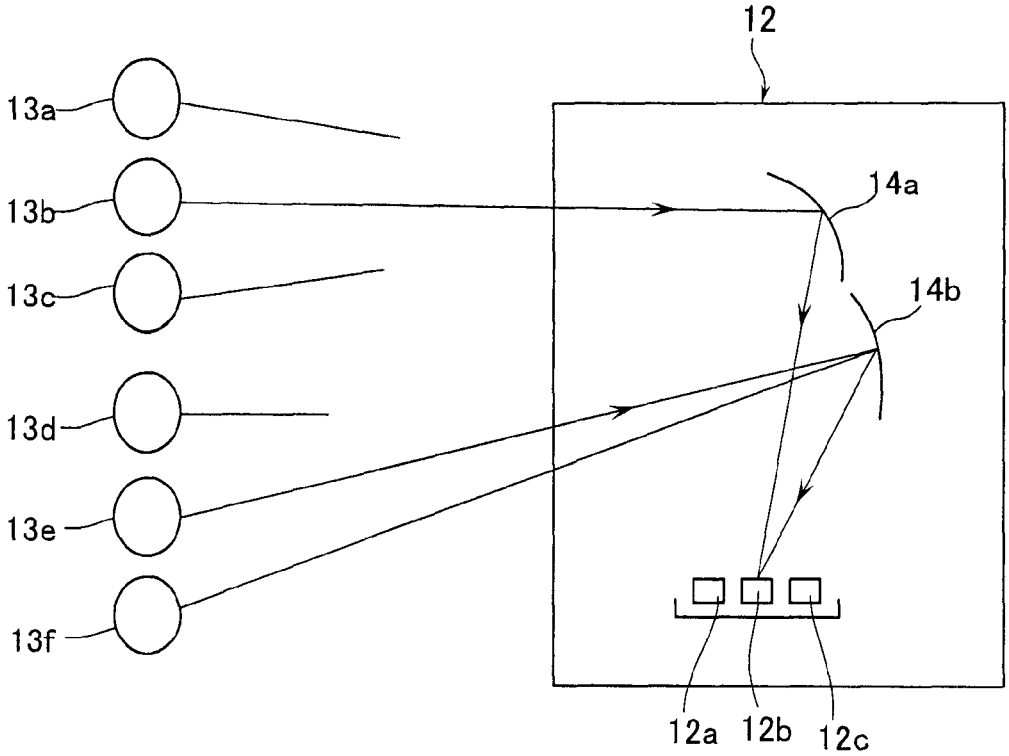
FIG. 6 is a structural diagram of the detection part of yet another embodiment of the present invention.

FIG. 6 shows another embodiment in which in place of the lens 5 shown in FIG. 4, two concave mirrors 14*a* and 14*b* are employed. By using the two concave mirrors 14*a* and 14*b*, the area for the detection of the body temperature of the intruder is widened to include the detection spaces 13*a*, 13*b* and 13*c* as well as the detection spaces 13*d*, 13*e* and 13*f*.

For example, the thermopile 12*b* can detect the detection space 13*b* as well as the detection space 13*e*, in the case of the detection space 13*b*, by the reflection on the concave mirror 14*a*, and in the case of detection space 13*e*, by the reflection on the concave mirror 14*b*. Likewise, by using two lenses, in place of two concave mirrors, the detection space can be expanded.

In a similar manner, by using more than two concave mirrors or lenses, further expansion of the detection space is possible.

Figure 7:
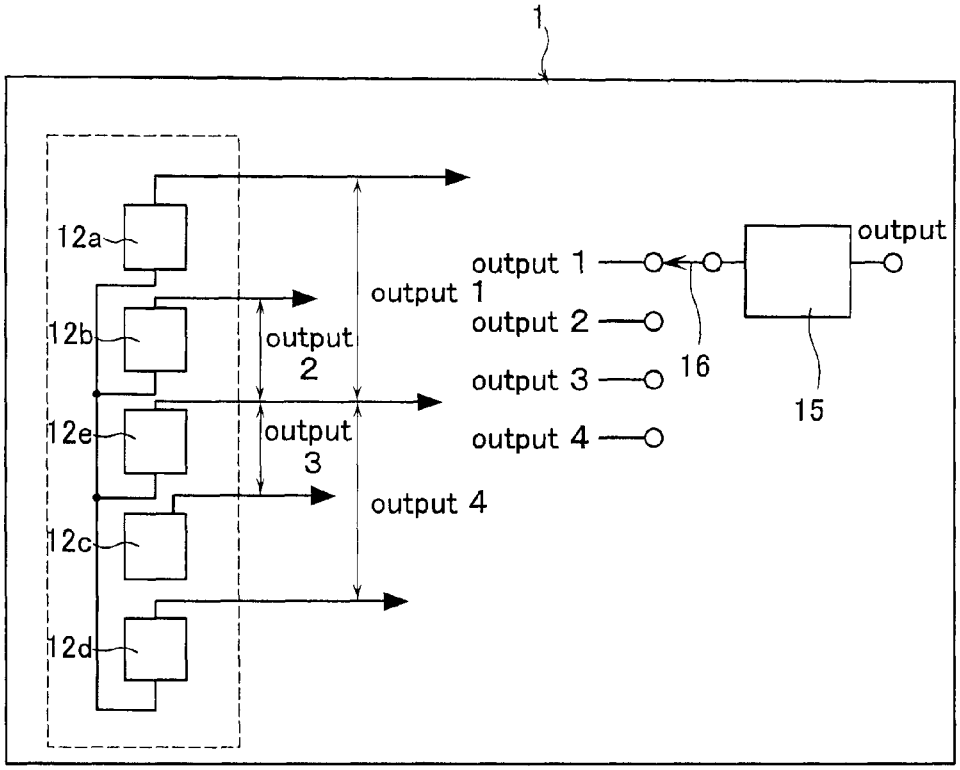
FIG. 7 is a block diagram of the detection apparatus of an embodiment of the present invention.

FIG. 7 shows yet another embodiment.

The detection apparatus 1 of this embodiment is comprised of a plurality of thermopiles 12*a*, 12*b*, 12*c*, 12*d* and 12*e*, and the amplifier 15 connected to those thermopiles through the electronic switch 16, which amplifies the respective output differences (output 1 through output 4) between the respective outputs of the thermopile 12*a*, 12*b*, 12*c* and 12*d*, on the one hand, and that of the thermopile 12*e*, on the other hand. These output differences (output 1 through output 4) are sequentially detected by switching the electronic switch 16.

The output differences E are shown as the equations below.

$$E=|12a-12e|,\ |12b-12e|,\ |12c-12e|,\ |12d-12e|$$

In case that the room temperature goes up or down, the temperatures of thermopiles 12*a*, 12*b*, 12*c*, 12*d* and 12*e* change simultaneously in accordance with such room temperature change; therefore, ordinarily, the output differences E are zero or extremely close to zero.

And, if an intruder intrudes into the detection space, the thermopile which has detected the body temperature of the intruder generates a different detection value than those of other thermopiles; therefore, the detection of the intrusion can be done with certainty.

Incidentally, in the above embodiment, the thermopile e is used as a reference in order to obtain the output differences E among the thermopiles; however, other thermopiles 12*a*, 12*b*, 12*c* or 12*d* may be chosen as a reference in place of the thermopile 12*e*; furthermore, it is not necessary to limit the number of reference thermopile to one.

Figure 8:
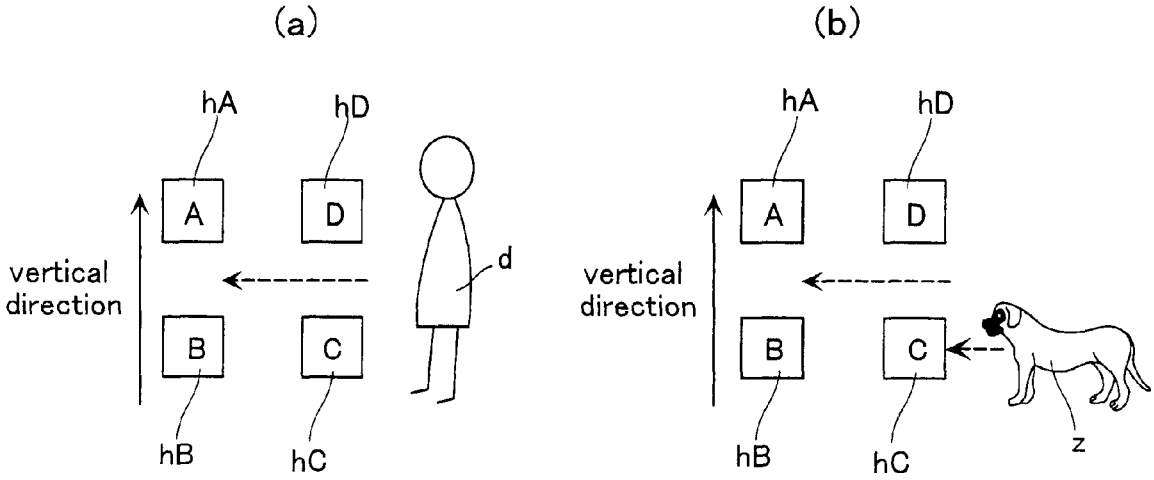
FIG. 8 is a diagram for explaining another embodiment of the present invention.
Figure 9:
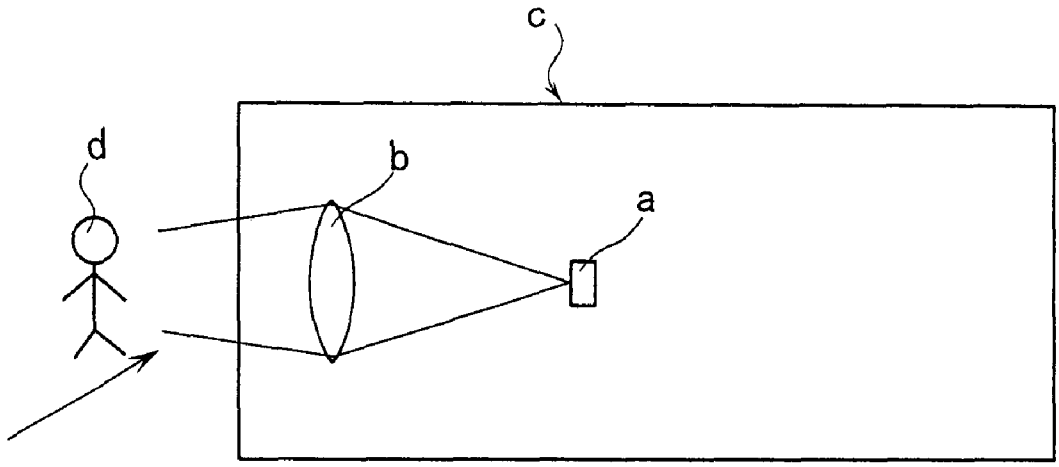
FIG. 9 is a structural diagram of the conventional detection apparatus.
Figure 10:
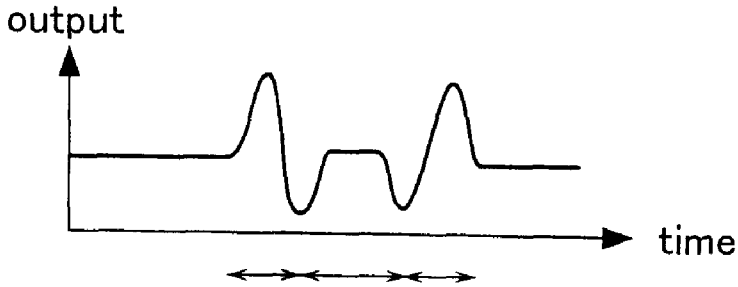
PRIOR ART FIG. 10
FIG. 10 is a chart showing the relationship between the time and outputs of the above detection apparatus when a human body moves at a high speed in the detection space.
Figure 11:
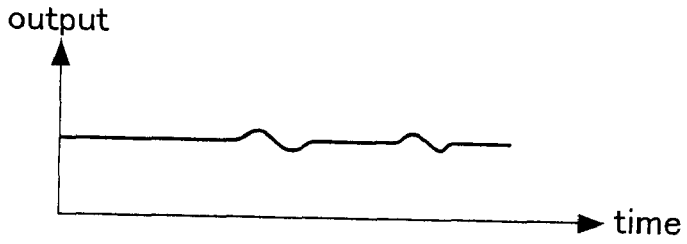
FIG. 11 is a chart showing the relationship between the time and outputs of the above detection apparatus when a human body moves at a low speed in the detection space.
Figure 12:
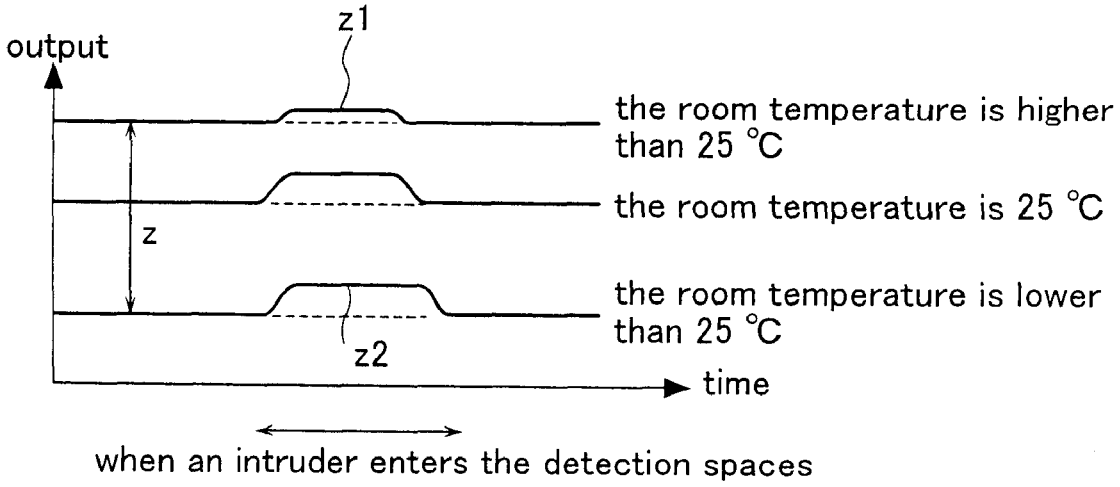
PRIOR ART FIG. 12
FIG. 12 is a chart showing the relationship between the room temperature and the outputs of the detection apparatus which uses thermopiles.
Figure 13:
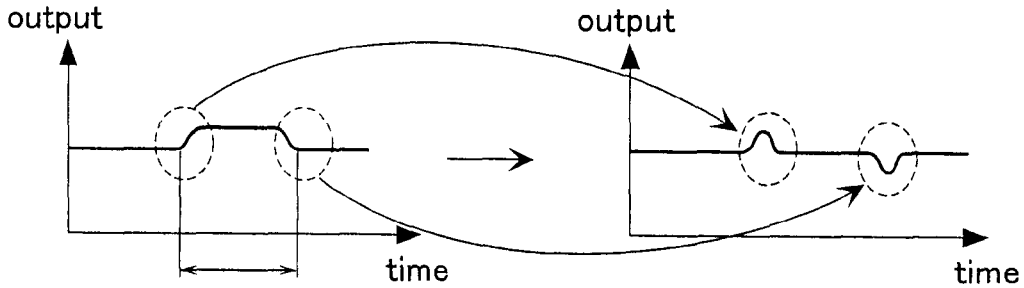
FIG. 13 is a chart showing the relationship between the room temperature and the outputs to explain the output signal processing method of the above detection apparatus.
Figure 14:
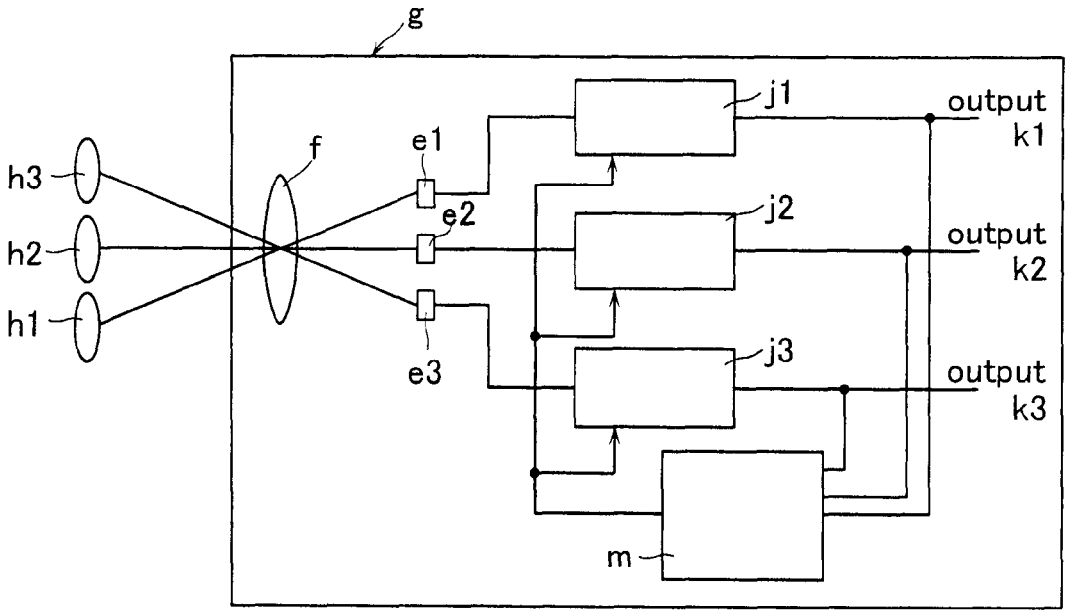
PRIOR ART FIG. 14
FIG. 14 is a block diagram of another conventional detection apparatus.
Figure 15A:
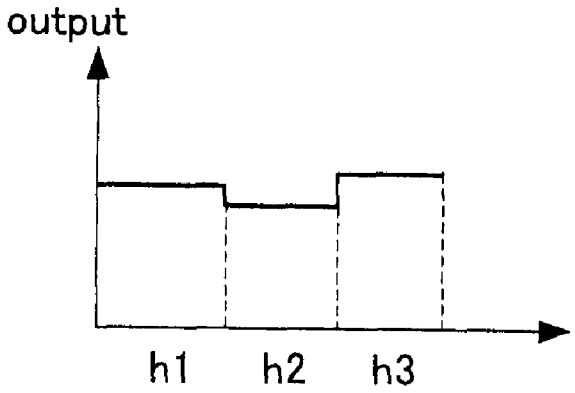
FIG. 15 is a chart showing the relationship between the detection space and outputs of the above detection apparatus.
Figure 15B:
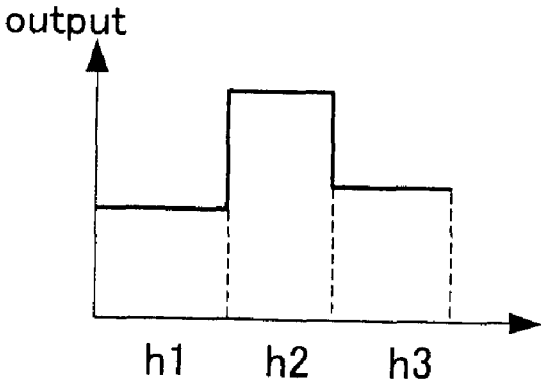
PRIOR ART FIG. 15(B)
Figure 16:
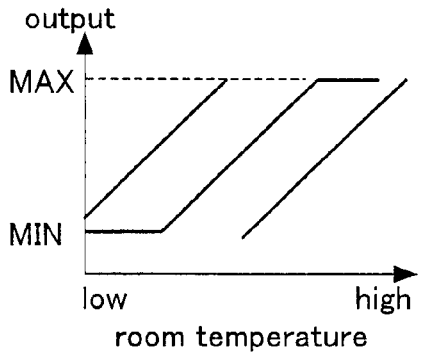
FIG. 16 is a chart showing the output condition of the above detection apparatus in response to the changes of the room temperature.
Figure 17:
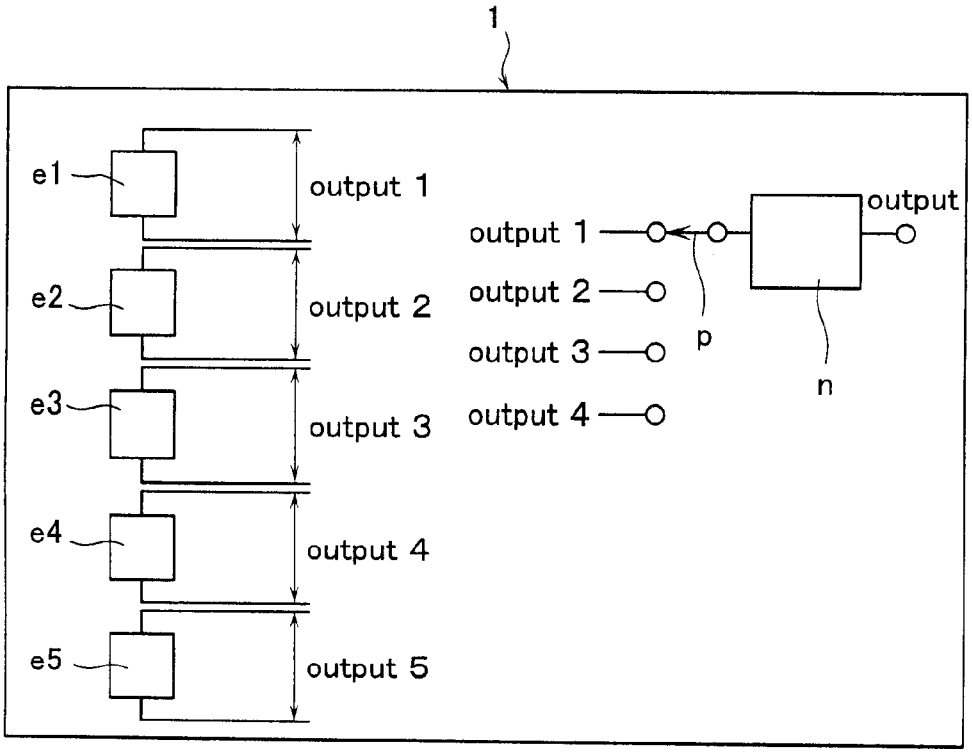
PRIOR ART FIG. 17
FIG. 17 is a block diagram of yet another conventional detection apparatus.

With reference to FIG. 8, yet another embodiment will be explained.

In that figure, each of hA, hB, hC and hD indicates monitoring space; and the monitoring space hA and the monitoring space hB as well as the monitoring space hD and the monitoring space hC are aligned in the vertical (column) direction; and the monitoring space hA and the monitoring space hD as well as the monitoring space hB and the monitoring space hC are aligned in the horizontal (row) direction. Accordingly, although it is not shown in the figure, the thermopiles are arranged in 2×2. In the figure, d shows an intruder and z shows a small animal.

As shown in FIG. 8(*a*), assuming that the intruder d moves toward left side on the figure, no output differences between the monitoring space hD and the monitoring space hC aligned in the column direction or between the monitoring space hA and the monitoring space hB aligned in the column direction are caused. However, output differences between the monitoring space hD and the monitoring space hA aligned in the row direction and between the monitoring space hC and the monitoring space hB aligned in the row direction occur.

In comparison, as shown in FIG. 8(*b*), assuming that the small animal z moves toward left side on the figure, output differences between the monitoring space hD and the monitoring space hC aligned in the column direction and between the monitoring space hA and the monitoring space hB aligned in the column direction occur. And, output difference between the monitoring space hC and the monitoring space hB aligned in the row direction at the bottom occurs. But, no output difference between the monitoring space hD and the monitoring space hA aligned in the row direction at the top is caused.

As shown in the foregoing, the output differences between the monitoring locations in the vertical directions (the monitoring space hA and the monitoring space hB, or, the monitoring space hD and the monitoring space hC) differ in such a way that in the case of a small animal it will be large, and in the case of an intruder it will be small; therefore, by detecting such differences, it is possible to avoid a detection error which is caused by a small animal.

As apparent from the explanations of the above embodiments, according to the present invention, an intrusion of an intruder is not detected by capturing a thermal image such that the differences between the body temperature of the intruder and the room temperature are depicted; rather, the amount of far infrared radiation is detected by the output differences among the thermopile; therefore, there will be no influence to be caused by the changes of the room temperature and an intrusion can be detected with certainty.

Further, according to this invention, even if an intruder covers the front of the detection apparatus by a shield plate in an attempt to cause abstractions in the detection apparatus's detection, this shielding can be detected.

Furthermore, according to this invention, the outputs from the thermopiles are not captured as an image, but rather the detection is done from the outputs differences of each device directly, the privacy protection can be assured.

What is claimed is:

1. A thermopile far infrared radiation detection apparatus for crime prevention utilizing three or more thermopiles to detect an intruder into a space, characterized in that:

an output difference between detection values outputted from a pair of said thermopiles is obtained; and said intruder is detected by the comparison between said output differences obtained from different pairs of said thermopiles.

2. A thermopile far infrared radiation detection apparatus for crime prevention in accordance with the claim 1, wherein, said output differences are obtained without amplifying said detection values from said thermopiles.

3. A thermopile far infrared radiation detection apparatus for crime prevention in accordance with the claim 1, wherein, nine or less of said thermopiles are arranged in array.

4. A thermopile far infrared radiation detection apparatus for crime prevention in accordance with the claim 1, wherein, in the case that signal difference between said output differences is below a first predetermined value, it will be judged that there is no intruder, and in the case said signal difference is below a second predetermined value, which is set at the value which is below said first predetermined value but is greater than zero, then it will be judged that a detection obstruction is perpetrated.

5. A thermopile far infrared radiation detection apparatus for crime prevention in accordance with any of the claims 1 through 4, wherein, said thermopile far infrared radiation detection apparatus for crime prevention is installed indoor.

6. A thermopile far infrared radiation detection apparatus for crime prevention in which thermopiles are arranged in array consisting a plurality of rows and a plurality of columns to detect an intruder into a space, characterized in that:

an output difference between detection values outputted from a pair of said thermopiles which are aligned in said column direction and an output difference between detection values outputted from a pair of said thermopiles which are aligned in said row direction are obtained; and said intruder is detected by the comparison between said output differences.

* * * * *